US008162047B2

(12) United States Patent
Chase et al.

(10) Patent No.: US 8,162,047 B2
(45) Date of Patent: Apr. 24, 2012

(54) REVERSE-CIRCULATION CEMENTING OF SURFACE CASING

(75) Inventors: Stephen Chase, Calgary (CA); Gary Maier, Calgary (CA)

(73) Assignee: Halliburton Energy Services Inc., Duncan, OK (US)

( * ) Notice: Subject to any disclaimer, the term of this patent is extended or adjusted under 35 U.S.C. 154(b) by 188 days.

(21) Appl. No.: 12/616,967

(22) Filed: Nov. 12, 2009

(65) Prior Publication Data

US 2010/0051277 A1 Mar. 4, 2010

Related U.S. Application Data

(62) Division of application No. 11/778,261, filed on Jul. 16, 2007, now Pat. No. 7,654,324.

(51) Int. Cl.
*E21B 33/14* (2006.01)

(52) U.S. Cl. ..... 166/177.4; 166/285; 166/70

(58) Field of Classification Search ..... 166/285, 166/70, 177.4, 287, 291
See application file for complete search history.

(56) References Cited

U.S. PATENT DOCUMENTS

| | | | |
|---|---|---|---|
| 2,223,509 | A | 12/1940 | Brauer |
| 2,230,589 | A | 2/1941 | Driscoll |
| 2,407,010 | A | 9/1946 | Hudson |
| 2,472,466 | A | 6/1949 | Counts et al. |
| 2,647,727 | A | 8/1953 | Edwards |
| 2,675,082 | A | 4/1954 | Hall |
| 2,849,213 | A | 8/1958 | Failing |
| 2,919,709 | A | 1/1960 | Schwegman |
| 3,051,246 | A | 8/1962 | Clark, Jr. et al. |
| 3,193,010 | A | 7/1965 | Bielstein |
| 3,277,962 | A | 10/1966 | Flickinger et al. |
| 3,570,596 | A | 3/1971 | Young |
| 3,948,322 | A | 4/1976 | Baker |
| 3,948,588 | A | 4/1976 | Curington et al. |
| 3,951,208 | A | 4/1976 | Delano |
| 4,105,069 | A | 8/1978 | Baker |
| 4,271,916 | A | 6/1981 | Williams |
| 4,300,633 | A | 11/1981 | Stewart |
| 4,304,298 | A | 12/1981 | Sutton |

(Continued)

FOREIGN PATENT DOCUMENTS

EP 0 419 281 A2 3/1991

(Continued)

OTHER PUBLICATIONS

Griffith, et al., "Reverse Circulation of Cement on Primary Jobs Increases Cement Column Height Across Weak Formations," Society of Petroleum Engineers, SPE 25440, 315-319, Mar. 22-23, 1993.

(Continued)

*Primary Examiner* — David Andrews
(74) *Attorney, Agent, or Firm* — John W. Wustenberg; Baker Botts, LLP

(57) ABSTRACT

An apparatus for reverse circulation cementing of surface casing in subterranean formations and associated methods are provided. One example of a method may involve a method of reverse circulation cementing a surface casing in a well bore with a conductor casing positioned therein comprising: providing a tool comprising at least one isolation device coupled to the surface casing; positioning the isolation device in the well bore to isolate an annulus between the surface casing and the conductor casing; flowing cement through a port in the conductor casing in a reverse circulation direction; and allowing the cement to set therein.

8 Claims, 4 Drawing Sheets

U.S. PATENT DOCUMENTS

| | | | |
|---|---|---|---|
| 4,340,427 | A | 7/1982 | Sutton |
| 4,367,093 | A | 1/1983 | Burkhalter et al. |
| RE31,190 | E | 3/1983 | Detroit et al. |
| 4,450,010 | A | 5/1984 | Burkhalter et al. |
| 4,457,379 | A | 7/1984 | McStravick |
| 4,469,174 | A | 9/1984 | Freeman |
| 4,519,452 | A | 5/1985 | Tsao et al. |
| 4,531,583 | A | 7/1985 | Revett |
| 4,548,271 | A | 10/1985 | Keller |
| 4,555,269 | A | 11/1985 | Rao et al. |
| 4,565,578 | A | 1/1986 | Sutton et al. |
| 4,671,356 | A | 6/1987 | Barker et al. |
| 4,676,832 | A | 6/1987 | Childs et al. |
| 4,729,432 | A | 3/1988 | Helms |
| 4,791,988 | A | 12/1988 | Trevillion |
| 4,961,465 | A | 10/1990 | Brandell |
| 5,024,273 | A | 6/1991 | Coone et al. |
| 5,117,910 | A | 6/1992 | Brandell et al. |
| 5,125,455 | A | 6/1992 | Harris et al. |
| 5,133,409 | A | 7/1992 | Bour et al. |
| 5,147,565 | A | 9/1992 | Bour et al. |
| 5,188,176 | A | 2/1993 | Carpenter |
| 5,213,161 | A | 5/1993 | King et al. |
| 5,273,112 | A | 12/1993 | Schultz |
| 5,297,634 | A | 3/1994 | Loughlin |
| 5,318,118 | A | 6/1994 | Duell |
| 5,323,858 | A | 6/1994 | Jones et al. |
| 5,361,842 | A | 11/1994 | Hale et al. |
| 5,484,019 | A | 1/1996 | Griffith |
| 5,494,107 | A | 2/1996 | Bode |
| 5,507,345 | A | 4/1996 | Wehunt, Jr. et al. |
| 5,559,086 | A | 9/1996 | Dewprashad et al. |
| 5,571,281 | A | 11/1996 | Allen |
| 5,577,865 | A | 11/1996 | Manrique et al. |
| 5,641,021 | A | 6/1997 | Murray et al. |
| 5,647,434 | A | 7/1997 | Sullaway et al. |
| 5,671,809 | A | 9/1997 | McKinzie |
| 5,718,292 | A | 2/1998 | Heathman et al. |
| 5,738,171 | A | 4/1998 | Szarka |
| 5,749,418 | A | 5/1998 | Mehta et al. |
| 5,762,139 | A | 6/1998 | Sullaway et al. |
| 5,803,168 | A | 9/1998 | Lormand et al. |
| 5,829,526 | A | 11/1998 | Rogers et al. |
| 5,875,844 | A | 3/1999 | Chatterji et al. |
| 5,890,538 | A | 4/1999 | Beirute et al. |
| 5,897,699 | A | 4/1999 | Chatterji et al. |
| 5,900,053 | A | 5/1999 | Brothers et al. |
| 5,913,364 | A | 6/1999 | Sweatman |
| 5,968,255 | A | 10/1999 | Mehta et al. |
| 5,972,103 | A | 10/1999 | Mehta et al. |
| 6,060,434 | A | 5/2000 | Sweatman et al. |
| 6,063,738 | A | 5/2000 | Chatterji et al. |
| 6,098,710 | A | 8/2000 | Rhein-Knudsen et al. |
| 6,138,759 | A | 10/2000 | Chatterji et al. |
| 6,143,069 | A | 11/2000 | Brothers et al. |
| 6,167,967 | B1 | 1/2001 | Sweatman |
| 6,196,311 | B1 | 3/2001 | Treece et al. |
| 6,204,214 | B1 | 3/2001 | Singh et al. |
| 6,244,342 | B1 | 6/2001 | Sullaway et al. |
| 6,258,757 | B1 | 7/2001 | Sweatman et al. |
| 6,311,775 | B1 | 11/2001 | Allamon et al. |
| 6,318,472 | B1 | 11/2001 | Rogers et al. |
| 6,367,550 | B1 | 4/2002 | Chatterji et al. |
| 6,431,282 | B1 | 8/2002 | Bosma et al. |
| 6,454,001 | B1 | 9/2002 | Thompson et al. |
| 6,457,524 | B1 | 10/2002 | Roddy |
| 6,467,546 | B2 | 10/2002 | Allamon et al. |
| 6,481,494 | B1 | 11/2002 | Dusterhoft et al. |
| 6,484,804 | B2 | 11/2002 | Allamon et al. |
| 6,488,088 | B1 | 12/2002 | Kohli et al. |
| 6,488,089 | B1 | 12/2002 | Bour et al. |
| 6,488,763 | B2 | 12/2002 | Brothers et al. |
| 6,540,022 | B2 | 4/2003 | Dusterhoft et al. |
| 6,554,247 | B2 * | 4/2003 | Berckenhoff et al. ..... 251/1.3 |
| 6,622,798 | B1 | 9/2003 | Rogers et al. |
| 6,666,266 | B2 | 12/2003 | Starr et al. |
| 6,679,336 | B2 | 1/2004 | Musselwhite et al. |
| 6,715,553 | B2 | 4/2004 | Reddy et al. |
| 6,722,434 | B2 | 4/2004 | Reddy et al. |
| 6,725,935 | B2 | 4/2004 | Szarka et al. |
| 6,732,797 | B1 | 5/2004 | Watters |
| 6,758,281 | B2 | 7/2004 | Sullaway et al. |
| 6,802,374 | B2 | 10/2004 | Edgar et al. |
| 6,808,024 | B2 | 10/2004 | Schwendemann et al. |
| 6,810,958 | B2 | 11/2004 | Szarka et al. |
| 2002/0148614 | A1 | 10/2002 | Szarka |
| 2003/0000704 | A1 | 1/2003 | Reynolds |
| 2003/0029611 | A1 | 2/2003 | Owens |
| 2003/0072208 | A1 | 4/2003 | Rondeau et al. |
| 2003/0192695 | A1 | 10/2003 | Dillenbeck et al. |
| 2004/0079553 | A1 | 4/2004 | Livingstone |
| 2004/0084182 | A1 | 5/2004 | Edgar et al. |
| 2004/0099413 | A1 | 5/2004 | Arceneaux |
| 2004/0104050 | A1 | 6/2004 | Järvelä et al. |
| 2004/0104052 | A1 | 6/2004 | Livingstone |
| 2004/0177962 | A1 | 9/2004 | Bour |
| 2004/0231846 | A1 | 11/2004 | Griffith et al. |
| 2005/0061546 | A1 | 3/2005 | Hannegan |
| 2006/0016599 | A1 | 1/2006 | Badalamenti et al. |
| 2006/0016600 | A1 | 1/2006 | Badalamenti et al. |
| 2006/0042798 | A1 | 3/2006 | Badalamenti et al. |
| 2006/0086499 | A1 | 4/2006 | Badalamenti et al. |
| 2006/0086502 | A1 | 4/2006 | Reddy et al. |
| 2006/0086503 | A1 | 4/2006 | Reddy et al. |
| 2006/0131018 | A1 | 6/2006 | Rogers et al. |

FOREIGN PATENT DOCUMENTS

| | | | |
|---|---|---|---|
| GB | 2193741 | | 2/1988 |
| GB | 2 327 442 | A | 1/1999 |
| GB | 2348828 | A | 10/2000 |
| RU | 1774986 | | 11/1992 |
| RU | 1778274 | | 11/1992 |
| RU | 1542143 | C | 12/1994 |
| RU | 2067158 | | 9/1996 |
| RU | 2086752 | C1 | 8/1997 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | A1 | 8/1992 |
| WO | WO 2004/104366 | | 12/2004 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Filippov, et al., "Expandable Tubular Solutions," Society of Petroleum Engineers, SPE 56500, Oct. 3-6, 1999.

Daigle, et al., "Expandable Tubulars: Field Examples of Application in Well Construction and Remediation," Society of Petroleum Engineers, SPE 62958, Oct. 1- 4, 2000.

Fryer, "Evaluation of the Effects of Multiples in Seismic Data From the Gulf Using Vertical Seismic Profiles," SPE 25540, 1993.

Carpenter, et al., "Remediating Sustained Casing Pressure by Forming a Downhole Annular Seal With Low-Melt-Point Eutectic Metal," IADC/SPE 87198, Mar. 2-4, 2004.

Halliburton Casing Sales Manual, Section 4, Cementing Plugs, pp. 4-29 and pp. 4-30, Oct. 6, 1993.

G.L. Cales, "The Development and Applications of Solid Expandable Tubular Technology," Paper No. 2003-136, Petroleum Society'S Canadian International Petroleum Conference 2003, Jun. 10-12, 2003.

Gonzales, et al., "Increasing Effective Fracture Gradients by Managing Wellbore Temperatures," IADC/SPE 87217, Mar. 2-4, 2004.

Griffith, "Monitoring Circulatable Hole With Real-Time Correction: Case Histories," SPE 29470, 1995.

Ravi, "Drill-Cutting Removal in a Horizontal Wellbore for Cementing," IADC/SPE 35081, 1996.

MacEachern, et al., "Advances in Tieback Cementing," IADC/SPE 79907, 2003.

Davies, et al, "Reverse Circulation of Primary Cementing Jobs—Evaluation and Case History," IADC/SPE 87197, Mar. 2-4, 2004.

Abstract No. XP-002283587, "Casing String Reverse Cemented Unit Enhance Efficiency Hollow Pusher Housing", 1992.
Abstract No. XP-002283586, "Reverse Cemented Casing String Reduce Effect Intermediate Layer Mix Cement Slurry Drill Mud Quality Lower Section Cement Lining", 1988.
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing Flexplug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the Stratalock Stabilization System", 1998.
R. Marquaire et al., "Primary Cementing by Reverse Circulation Solves Critical Problem in the North Hassi-Messaoud Field, Algeria", SPE 1111, Feb. 1966.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "Pozmix® a Cement Additive", 1999.
Foreign Communication From a Related Counter Part Application, Dec. 9, 2005.
Foreign Communication From a Related Counter Part Application, Feb. 24, 2005.
Foreign Communication From a Related Counter Part Application, Dec. 27, 2005.
Foreign Communication From a Related Counter Part Application, Feb. 23, 2006.
Foreign Communication From a Related Counter Part Application, Feb. 27, 2007.
Foreign Communication From a Related Counter Part Application, Jan. 8, 2007.
Foreign Communication From a Related Counter Part Application, Jan. 17, 2007.

* cited by examiner

REVERSE-CIRCULATION CEMENTING OF SURFACE CASING

CROSS-REFERENCE TO RELATED APPLICATIONS

This application is a divisional of U.S. patent application Ser. No. 11/778,261 filed Jul. 16, 2007, issued as U.S. Pat. No. 7,654,324 which is hereby incorporated by reference in its entirety.

BACKGROUND

The present disclosure generally relates to subterranean cementing operations. More particularly, the present disclosure relates to an apparatus for reverse circulation cementing of surface casing in subterranean formations and associated methods of use.

Cementing of a casing string is often accomplished by pumping a cement slurry down the inside of a tubing or a casing, and then back up the annular space around the casing. In this way, a cement slurry may be introduced into the annular space of the casing (e.g. the annular space between the casing to be cemented and the open hole or outer casing to which the casing is to be cemented). Such methods often are referred to as conventional circulation methods.

Though conventional circulation methods are the methods most commonly used for pumping cement compositions into well bores, these methods may be problematic in certain circumstances. For instance, a well bore may comprise one or more weak formations therein that may be unable to withstand the pressure commonly associated with conventional circulation cementing operations. The formation may breakdown under the hydrostatic pressure applied by the cement, thereby causing the cement to be lost into the subterranean formation. This may cause the undesirable loss of large amounts of cement into the subterranean formation. This problem may be referred to as "lost circulation" and the sections of the formation into which the fluid may be lost may be referred to as "lost circulation zones." The loss of cement into the formation is undesirable, among other things, because of the expense associated with the cement lost into the formation. Likewise, high delivery pressures can cause the undesirable effect of inadvertently "floating" the casing string. That is, exposing the bottom hole of the well bore to high delivery pressures can, in some cases, cause the casing string to "float" upward. Moreover, the equivalent circulating density of the cement may be high, which may lead to problems, especially in formations with known weak or lost circulation zones.

Another method of cementing casing, sometimes referred to as reverse circulation cementing, involves introducing the cement slurry directly from the surface into the annular space rather than introducing the cement slurry down the casing string itself. In particular, reverse circulation cementing avoids the higher pressures necessary to lift the cement slurry up the annulus. Other disadvantages of having to pump the cement slurry all the way down the casing string and then up the annulus are that it requires a much longer duration of time than reverse circulation cementing. This increased job time is disadvantageous because of the additional costs associated with a longer duration cementing job. Moreover, the additional time required often necessitates a longer set delay time, which may require additional set retarders or other chemicals to be added to the cement slurry.

Typically, when cementing strings of casing, such as production casing or intermediate casing, a means of isolating the annulus is required to divert flowback of the cement up and out to the flowline. Such methods often require the use of conventional pack-off means such as a diverter or blowout preventers. Moreover, a volume based method is typically used, wherein the anticipated volume of cement needed to cement the casing string is calculated. The calculated volume may be doubled or even tripled in some instances and that amount of cement may be pumped into the formation to cement the casing string. This method causes excessive cement waste and costs affiliated with the volume of cement used.

Reverse circulation cementing of surface casing may pose certain obstacles as well. In the presence of only a conductor casing or in an open-hole, a diverter may need to be installed on a conductor casing prior to reverse circulation cementing a surface casing to isolate the annulus between a conductor casing and a surface casing. These structures are often complex and expensive, thus increasing the cost of completing the well. Moreover, in certain regions of the world, the number of diverters available for use in cementing operations may be unable to accommodate the demand for them. Thus, there is a need for a cost-effective and readily available means to isolate the annulus between a conductor casing and a surface casing for reverse circulation cementing of a surface casing.

SUMMARY

The present disclosure generally relates to subterranean cementing operations. More particularly, the present disclosure relates to an apparatus for reverse circulation cementing of surface casing in subterranean formations and associated methods of use.

In one embodiment, the present disclosure provides a system for reverse circulation cementing of a surface casing string comprising a conductor casing, a surface casing string positioned within the conductor casing, and an isolation device coupled to a surface casing string.

In another embodiment, the present disclosure provides a method of reverse circulation cementing a surface casing in a well bore with a conductor casing positioned therein comprising: providing a tool comprising at least one isolation device coupled to the surface casing; positioning the isolation device in the well bore to isolate an annulus between the surface casing and the conductor casing; flowing cement through a port in the conductor casing in a reverse circulation direction; and allowing the cement to set therein.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

The present disclosure generally relates to subterranean cementing operations. More particularly, the present disclosure relates to an apparatus for reverse circulation cementing of surface casing in subterranean formations and associated methods of use.

The apparatus and methods of the present disclosure may allow for reverse circulation cementing of a surface casing. In particular, the methods and apparatus of the present disclosure may allow for improved isolation of the annular space between the surface casing to be cemented and the outer casing and/or open hole to which the casing is to be cemented. In certain embodiments, this outer casing may be a conductor casing. The methods and apparatus of the present disclosure provide an efficient means for reverse circulation cementing of surface casing with a conductor casing in place, but in the absence of a diverter or blow out preventer. As used herein, "conductor casing" refers to a pipe installed in a well to provide a conductor for fluid through surface formations and prevent sloughing of the ground and formation. By eliminating the need for a diverter, the apparatus of the present disclosure may provide, a cost-effective alternative for reverse cementing surface casing in the presence of a conductor casing. Moreover, reverse circulation cementing of a surface casing using the apparatus and methods of the present disclosure may provide a means by which lost circulation may be minimized. In addition, the methods and apparatus of the present disclosure may provide savings in rig time and associated costs in labor and cement.

To facilitate a better understanding of the present invention, the following examples of certain aspects of some embodiments are given. In no way should the following examples be read to limit, or define, the entire scope of the invention.

Figure 1:
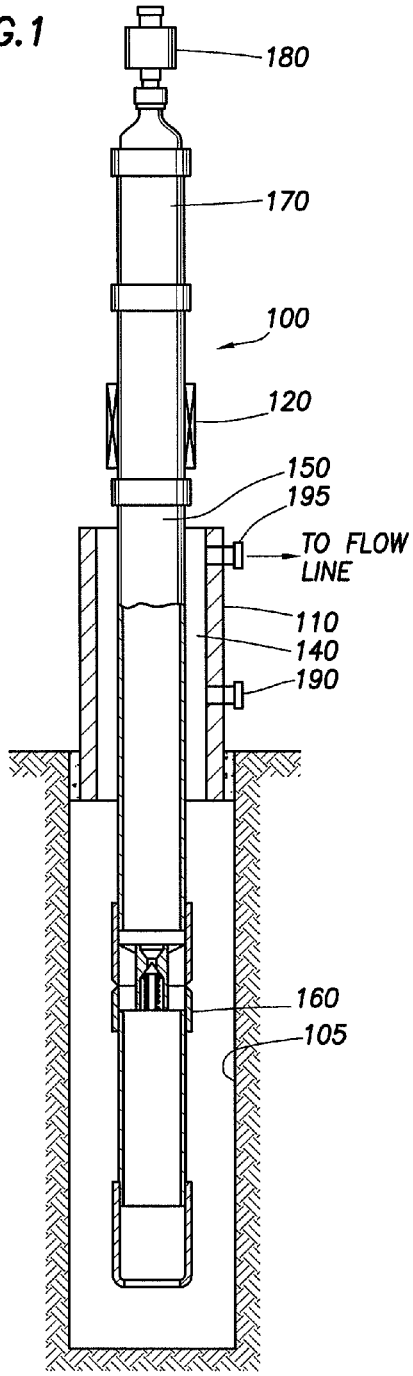
FIG. 1 illustrates a cross-sectional view of a reverse cementing apparatus, according to one embodiment of the present disclosure.

Referring now to FIG. 1, a reverse cementing tool is illustrated, according to one embodiment of the present disclosure. Initially, reverse cementing tool 100 is positioned above conductor casing 110 that is positioned in well bore 105. Conductor casing 110, though illustrated as cemented into well bore 105, may be positioned in wellbore 105 using any means known in the art. Reverse cementing tool 100 generally comprises an isolation device 120 coupled to a surface casing string 150. Isolation device 120 may be any device that provides at least partial fluidic isolation of annulus 140. In certain embodiments, isolation device 120 may comprise a rubber cup, a cement basket, or a permanent or retrievable packer. In certain other embodiments, isolation device 120 may comprise elastomeric materials, thermoplastic materials, inflatable packer, steel composites, resins, and expandable packers, or combinations thereof. Isolation device 120 may be coupled to surface casing string 150 by any means known in the art. In certain embodiments, more than one isolation device may be coupled to surface casing string 150.

In certain other embodiments, reverse cementing tool 100 may further comprise reverse cementing collar 160. Surface casing string 150 may be coupled to reverse cementing collar 160. U.S. Pat. No. 6,244,342 issued to Sullaway et al. on Jun. 12, 2001, which is herein incorporated by reference, discloses reverse cementing collars suitable for use in conjunction with the methods and apparatus of the present disclosure.

Reverse cementing tool 100 may further comprise handling sub 170 cement head 180, and isolation device 120. Handling sub 170 may be coupled to surface casing string 150, to provide a means by which reverse cementing tool 100 can be positioned in well bore 105. Cement head 180 may be coupled to handling sub 170. Cement head 180 may provide a means for flow through reverse cementing tool 100 in a conventional direction. Both cement head 180 and handling sub 170 may be coupled to surface casing string 150 using any means known to one of ordinary skill in the art. In the embodiment illustrated in FIG. 1, circulation of fluid may be established down surface casing string 150 and up annulus 140 in a conventional direction. Fluids suitable for use in this embodiment include any fluid that may be used in cementing and drilling operations. Examples of suitable fluids include, but are not limited to, circulation fluids, drilling fluids, displacement fluids, lost circulation pills, and spacer fluids. Conductor casing 110 may comprise at least two ports. Port 190 of conductor casing 110 may be used to collect fluid returns in this embodiment. Port 195 of conductor casing 110 serves as a connection to the flowline (not shown) and may also be used to collect fluid returns, in certain embodiments.

Figure 2:
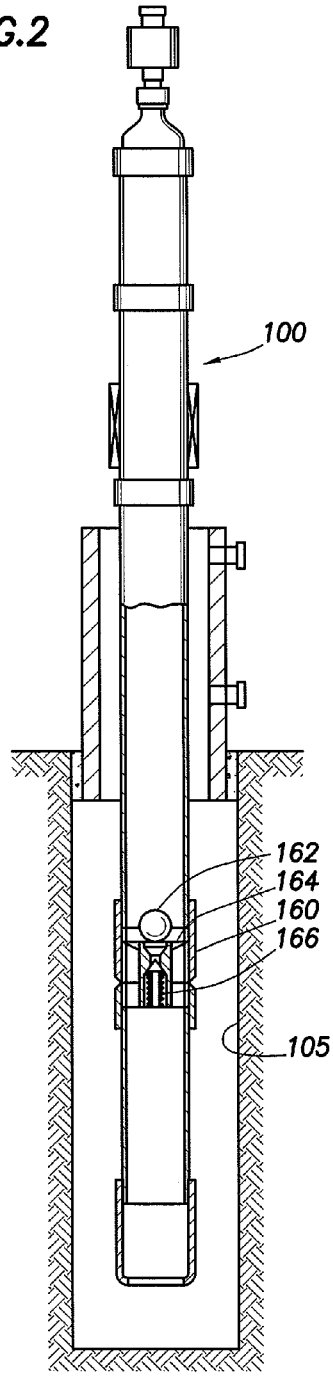
FIG. 2 illustrates a cross-sectional view of a reverse cementing apparatus, following dropping of a ball into the surface casing, according to one embodiment of the present disclosure.

Referring now to FIG. 2, once conventional circulation has been established, releasing ball 162 is dropped down reverse cementing tool 100 and engages seat 164 in reverse cementing collar 160. Pressure is applied to releasing ball 162 to disconnect check valve 166 from the reverse cementing collar 160.

Figure 3:
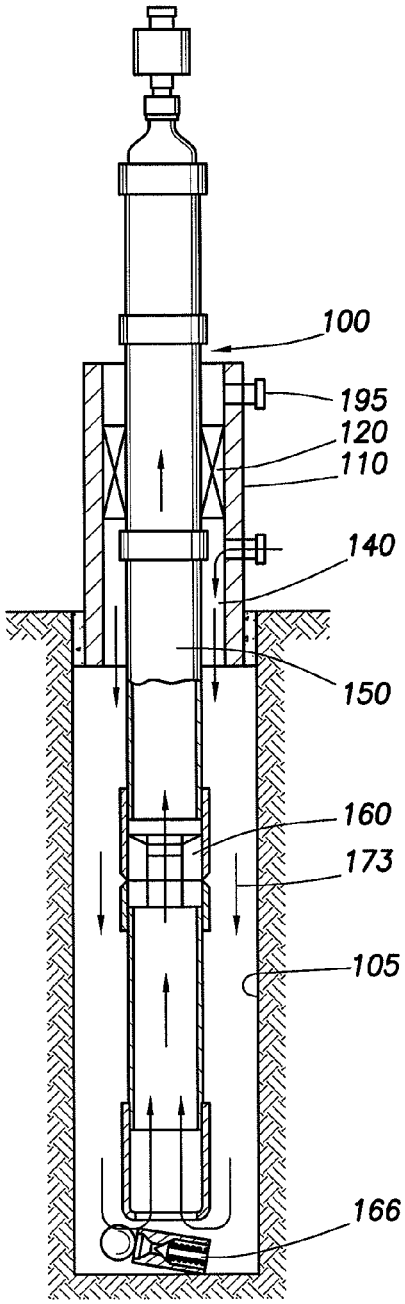
FIG. 3 illustrates a cross-sectional view of a reverse cementing apparatus, with surface casing lowered into place, following pumping of the check valve out of the string, according to one embodiment of the present disclosure.

Referring now to FIG. 3, check valve 166 has been released from reverse cementing collar 160, and reverse cementing tool 100 is ready for reverse circulation of fluid. Reverse cementing tool 100 is lowered into well bore 105 so that isolation device 120 contacts conductor casing 110 and forms a seal to isolate annulus 140 and port 195 to the flowline. Reverse cementing tool 100 may be lowered into well bore 105 using any means known in the art. Isolation device 120 may be positioned between port 195 to the flowline and port 190, thereby providing a seal between conductor casing 110 and the surface casing string 150. The seal allows for the effective isolation of annulus 140 thereby allowing surface casing string 150 to be cemented using a reverse cementing operation and preventing flowback of the cement out of the annulus 140. The size of isolation device 120 may be modified to accommodate a particular size of conductor casing 110.

Following placement of reverse cementing tool 100, reverse circulation of fluids may be established. Fluid 173 may be flowed into port 190 and down annulus 140 and up surface casing string 150. Fluids suitable for use in these embodiments include any fluid that may be used in cementing and drilling operations. Examples of suitable fluids include, but are not limited to, circulation fluids, drilling fluids, lost circulation pills, displacement fluids, and spacer fluids.

Figure 4:
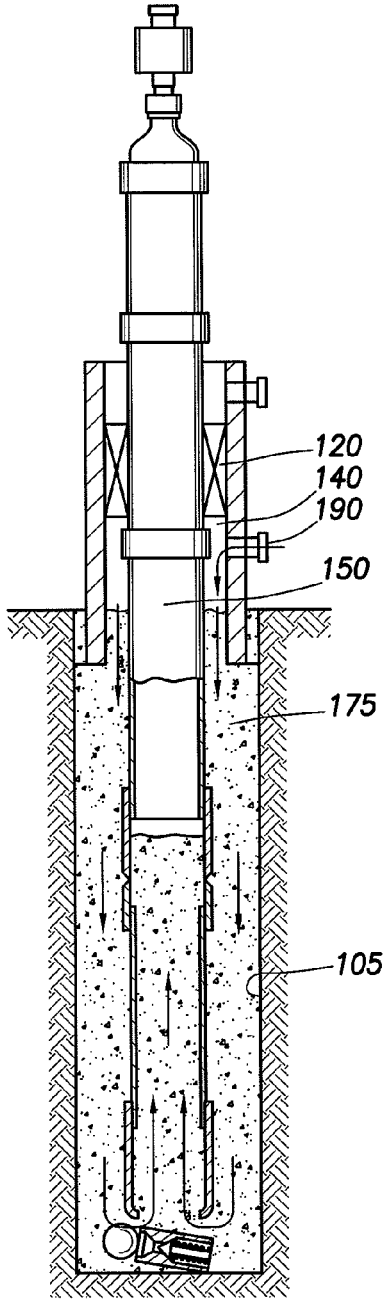
FIG. 4 illustrates pumping/flowing of a cement composition through a port in a conductor casing to cement a surface casing using a reverse circulation method, according to one embodiment of the present disclosure.

Cement slurry 175 may be introduced by pumping or any other means. Referring now to FIG. 4, cement slurry 175 may be pumped through port 190 and down annulus 140 to cement surface casing string 150 into well bore 105. Isolation device 120 provides a means to control the flow of cement slurry 175 and to isolate annulus 140 and port 195. By flowing cement slurry 175 in a reverse circulation direction, the equivalent circulating density of the cement slurry may be minimized. Moreover, damage to the formation and lost circulation may also be minimized.

Placement of cement slurry 175 is achieved due to free-fall of cement slurry 175 from port 190, down annulus 140, and around surface casing string 150. In certain embodiments, port 190 may serve as a means to inspect placement of the falling cement slurry 175. Cement slurry 175 may be any cement suitable for use to cement casing. Additional additives may be added to the cement used in conjunction with the methods and apparatus of the present invention as deemed appropriate by one skilled in the art with the benefit of this disclosure. Examples of such additives include, inter alia, fluid loss control additives, lost circulation materials, defoamers, dispersing agents, set accelerators, salts, formation conditioning agents, weighting agents, set retarders, and the like.

Figure 5:
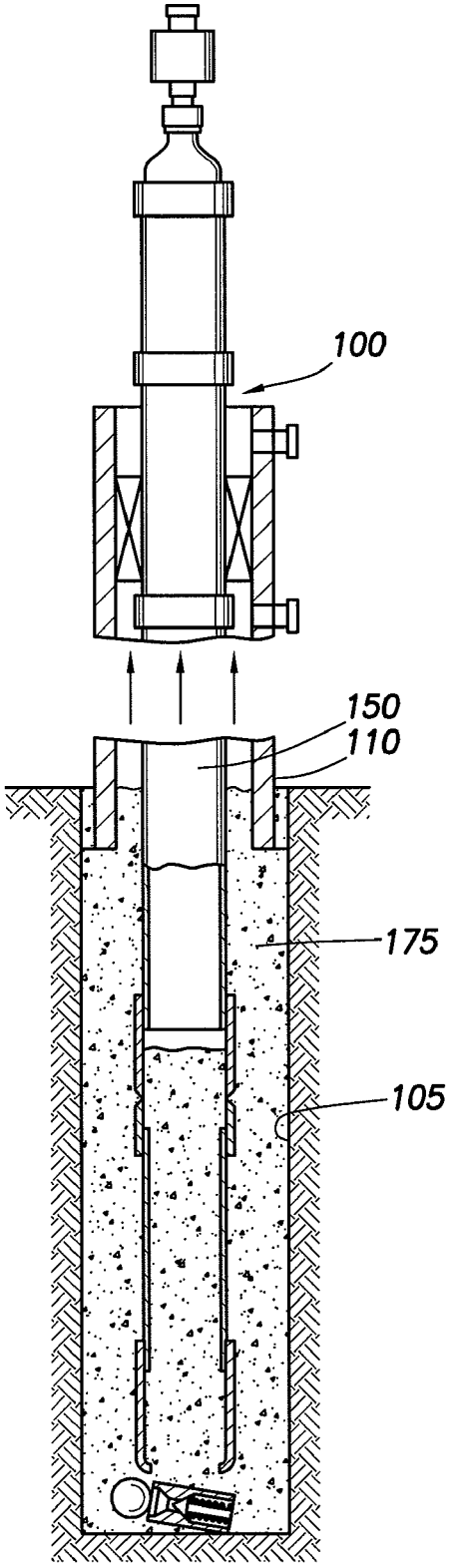
FIG. 5 illustrates a cross-sectional view of a surface casing, during removal of the reverse cementing apparatus, according to one embodiment of the present disclosure.
Figure 6:
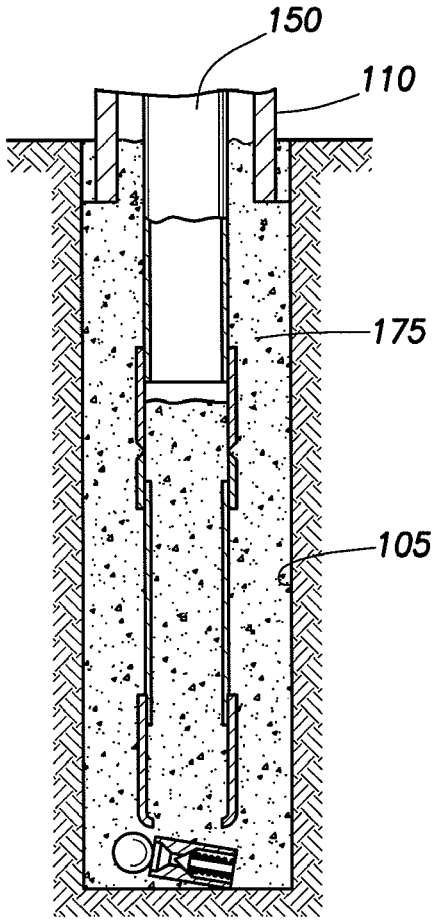
FIG. 6 illustrates a cross-sectional view of a surface casing following removal of the reverse cementing apparatus, according to one embodiment of the present disclosure.

Referring now to FIG. 5, following the reverse circulation cement job and setting of cement slurry 175, reverse cementing tool 100 may be detached from surface casing string 150 by any means known in the art. In the embodiment illustrated, reverse cementing tool 100 is cut from surface casing string 150 and conductor casing 110, leaving a portion of surface casing string 150 and conductor casing 110 cemented into place in well bore 105, as illustrated in FIG. 6. This allows for re-use of reverse cementing tool 100 in other well bore applications. Reverse cementing tool 100 may be removed from well bore 105 using any conventional means for positioning casing known in the art. Following the reverse cementing of surface casing string 150, additional well bore operations may be performed, including, but not limited to, installation of blow out preventers on top of the surface casing string, drilling operations, and placement and cementing of additional strings of casing.

Figure 7:
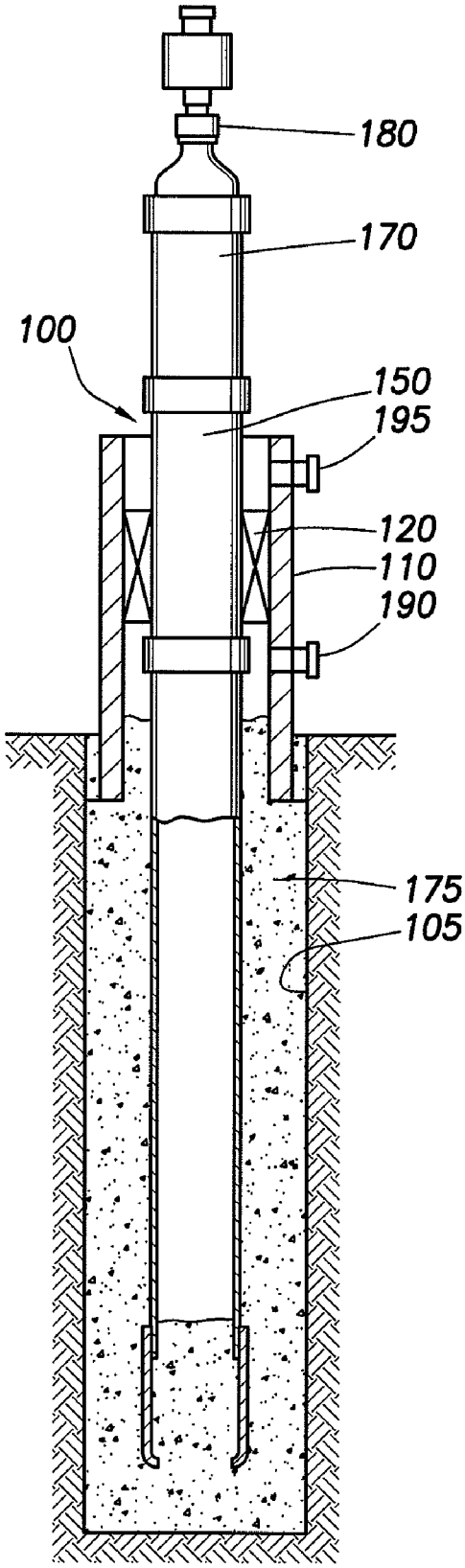
FIG. 7 illustrates a cross-sectional view of an alternative embodiment of the present disclosure that does not utilize a reverse cementing collar.

Referring now to FIG. 7, in certain embodiments, reverse cementing collar may be optionally omitted from surface casing string 150. Surface casing string 150 may be cemented using a reverse circulation method as described in previous embodiments of the present disclosure without the use of a reverse circulation collar.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A system for reverse circulation cementing of a surface casing string comprising a conductor casing comprising a first port and a second port, a surface casing string positioned within the conductor casing, and an isolation device coupled to the surface casing string;

wherein the surface casing string is movable between a first position and a second position within the conductor casing;

wherein at the first position the isolation device is above the first port and the second port; and wherein at the second position the isolation device is between the first port and the second port.

2. The system of claim 1 wherein the isolation device is a rubber cup, a cement basket, a permanent packer, a retrievable packer, an inflatable packer, or an expandable packer.

3. The system of claim 1 further comprising a handling sub.

4. The system of claim 1 wherein the isolation device comprises a material selected from elastomeric materials and thermoplastic materials, and combinations thereof.

5. The system of claim 1 further comprising a reverse cementing collar coupled to the surface casing string.

6. The system of claim 1 further comprising a cementing head coupled to the surface casing string.

7. The system of claim 1, wherein the surface casing string is positioned so that the isolation device provides a seal in an annulus formed between the surface casing string and the conductor casing.

8. The system of claim 1 wherein the conductor casing further comprises at least two ports, wherein the isolation device is positioned between the two ports to form a seal in an annulus formed between the surface casing string and the conductor casing.

* * * * *